US006216270B1

(12) United States Patent
Moquin et al.

(10) Patent No.: US 6,216,270 B1
(45) Date of Patent: Apr. 17, 2001

(54) PATIENT GARMENT HAVING ENHANCED ACCESSIBILITY

(76) Inventors: Gary J. Moquin; Patrick J. Moquin, both of 9 South St. #1, Worcester, MA (US) 01604

( * ) Notice: Subject to any disclaimer, the term of this patent is extended or adjusted under 35 U.S.C. 154(b) by 0 days.

(21) Appl. No.: 09/522,507

(22) Filed: Mar. 10, 2000

(51) Int. Cl.[7] ..... A41D 25/02
(52) U.S. Cl. ..... 2/69; 2/114; 2/115
(58) Field of Search ..... 2/69, 114, 115, 2/104, 105, 106, 108, 113, 80, 79, 75, 78.1, 83, 118, 119, 1

(56) References Cited

U.S. PATENT DOCUMENTS 302,901 * 8/1884 Fenne ..... 2/114
1,489,046 * 4/1924 Thompson ..... 2/114
2,911,650 * 11/1959 Gerich ..... 2/114
5,097,535 * 3/1992 Dye et al. ..... 2/69
5,133,086 * 7/1992 Truitt et al. ..... 2/114
5,331,685 * 7/1994 Belgard ..... 2/79
5,553,323 * 9/1996 Chou et al. ..... 2/114
5,564,126 * 10/1996 Chou ..... 2/114
5,621,917 * 4/1997 Howsden ..... 2/111
5,799,330 * 9/1998 O'Donoghue-Kitt ..... 2/114
5,946,722 * 9/1999 Trautmann ..... 2/83
6,014,772 * 1/2000 Connelly ..... 2/69

* cited by examiner

*Primary Examiner*—Gloria M. Hale

(57) ABSTRACT

A patient garment having enhanced accessibility for easy accessibility to a patient by health care workers. The patient garment having enhanced accessibility includes a body covering. The body covering comprises a torso portion and two sleeve portions fixedly coupled thereto. The body covering has a front side and a back side. The torso portion has a neck opening therein. A plurality of elongate openings is in the body covering. A plurality of closure means selectively open and close the elongate openings. Each of the closure means is fixedly coupled to one of the elongate openings.

7 Claims, 1 Drawing Sheet

PATIENT GARMENT HAVING ENHANCED ACCESSIBILITY

BACKGROUND OF THE INVENTION

1. Field of the Invention

The present invention relates to garments and more particularly pertains to a new patient garment having enhanced accessibility for easy accessibility to a patient by health care workers.

2. Description of the Prior Art

The use of garments is known in the prior art. More specifically, garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,603,123; U.S. Pat. No. 5,628,064; U.S. Pat. No. 5,553,323; U.S. Pat. No. 5,802,611; U.S. Pat. No. 5,097,535; and U.S. Des. Pat. No. 369,339.

While these devices fulfill their respective, particular objectives and requirements, the aforementioned patents do not disclose a new patient garment having enhanced accessibility. The inventive device includes a body covering. The body covering comprises a torso portion and two sleeve portions fixedly coupled thereto. The body covering has a front side and a back side. The torso portion has a neck opening therein. A plurality of elongate openings is in the body covering. A plurality of closure means selectively open and close the elongate openings. Each of the closure means is fixedly coupled to one of the elongate openings.

In these respects, the patient garment having enhanced accessibility according to the present invention substantially departs from the conventional concepts and designs of the prior art, and in so doing provides an apparatus primarily developed for the purpose of easy accessibility to a patient by health care workers.

SUMMARY OF THE INVENTION

In view of the foregoing disadvantages inherent in the known types of garments now present in the prior art, the present invention provides a new patient garment having enhanced accessibility construction wherein the same can be utilized for easy accessibility to a patient by health care workers.

The general purpose of the present invention, which will be described subsequently in greater detail, is to provide a new patient garment having enhanced accessibility apparatus and method which has many of the advantages of the garments mentioned heretofore and many novel features that result in a new patient garment having enhanced accessibility which is not anticipated, rendered obvious, suggested, or even implied by any of the prior art garments, either alone or in any combination thereof.

To attain this, the present invention generally comprises a body covering. The body covering comprises a torso portion and two sleeve portions fixedly coupled thereto. The body covering has a front side and a back side. The torso portion has a neck opening therein. A plurality of elongate openings is in the body covering. A plurality of closure means selectively open and close the elongate openings. Each of the closure means is fixedly coupled to one of the elongate openings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new patient garment having enhanced accessibility apparatus and method which has many of the advantages of the garments mentioned heretofore and many novel features that result in a new patient garment having enhanced accessibility which is not anticipated, rendered obvious, suggested, or even implied by any of the prior art garments, either alone or in any combination thereof.

It is another object of the present invention to provide a new patient garment having enhanced accessibility which may be easily and efficiently manufactured and marketed.

It is a further object of the present invention to provide a new patient garment having enhanced accessibility which is of a durable and reliable construction.

An even further object of the present invention is to provide a new patient garment having enhanced accessibility which is susceptible of a low cost of manufacture with regard to both materials and labor, and which accordingly is then susceptible of low prices of sale to the consuming public, thereby making such patient garment having enhanced accessibility economically available to the buying public.

Still yet another object of the present invention is to provide a new patient garment having enhanced accessibility which provides in the apparatuses and methods of the prior art some of the advantages thereof, while simultaneously overcoming some of the disadvantages normally associated therewith.

Still another object of the present invention is to provide a new patient garment having enhanced accessibility for easy accessibility to a patient by health care workers.

Yet another object of the present invention is to provide a new patient garment having enhanced accessibility which includes a body covering. The body covering comprises a torso portion and two sleeve portions fixedly coupled thereto. The body covering has a front side and a back side. The torso portion has a neck opening therein. A plurality of elongate openings is in the body covering. A plurality of closure means selectively open and close the elongate openings. Each of the closure means is fixedly coupled to one of the elongate openings.

Still yet another object of the present invention is to provide a new patient garment having enhanced accessibility that at least one opening in a sleeve portion for easy access to the arm of the patient.

Even still another object of the present invention is to provide a new patient garment having enhanced accessibility that has a back side having an opening therein to allow easy access of the patient into the body covering.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
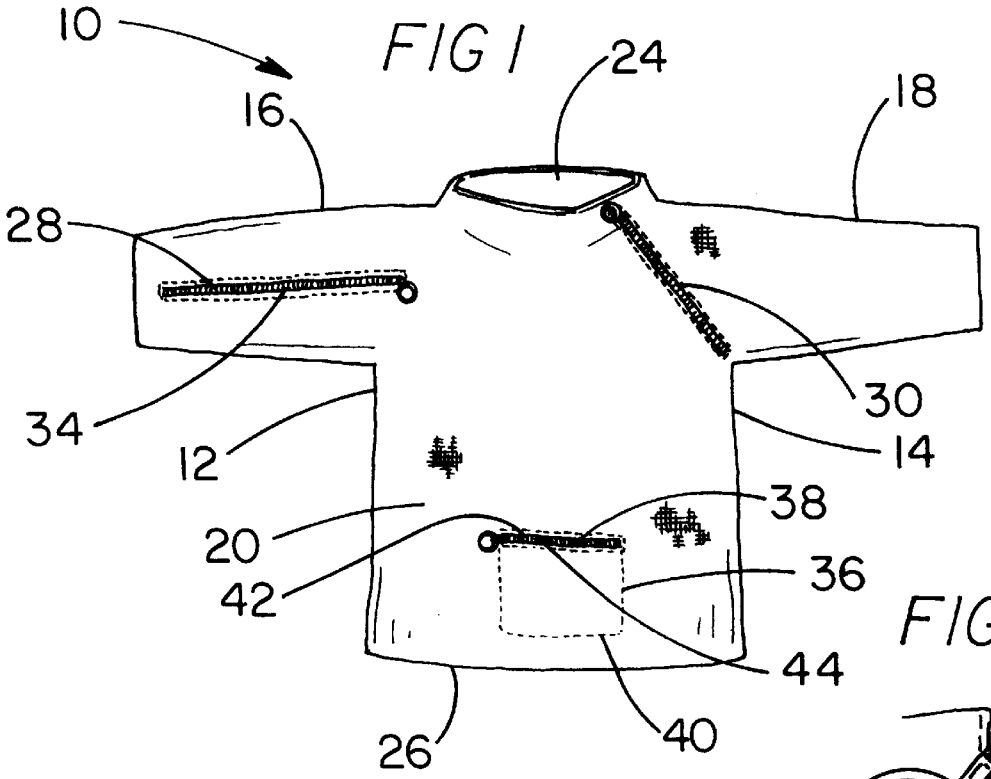
FIG. 1 is a schematic front view of a new patient garment having enhanced accessibility according to the present invention.
Figure 3:
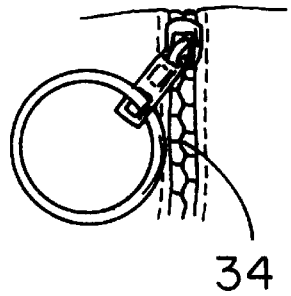
FIG. 3 is a schematic exploded view of the zipper of the present invention.
Figure 2:
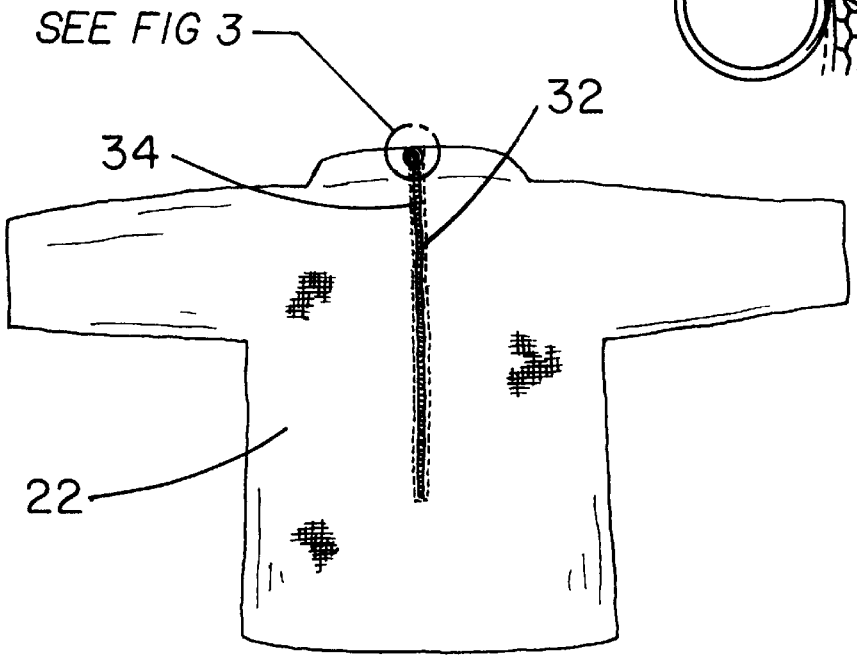
FIG. 2 is a schematic back view of the present invention.

With reference now to the drawings, and in particular to FIGS. 1 through 3 thereof, a new patient garment having enhanced accessibility embodying the principles and concepts of the present invention and generally designated by the reference numeral 10 will be described.

As best illustrated in FIGS. 1 through 3, the patient garment having enhanced accessibility 10 generally comprises a body covering 12. The body covering 12 includes a torso portion 14 and two sleeve portions 16, 18 fixedly coupled thereto. The body covering 12 has a front side 20 and a back side 22. The torso portion 14 has a neck opening 24 therein. The body covering 14 is made from a cloth material preferably selected from cotton, cotton fleece, wool, or synthetic fibers such as nylon or polyester.

A plurality of elongate openings is in the body covering 12. A first elongate opening 28 is in the front side 20 of a first 16 of the sleeve portions. The first elongate opening 28 is generally orientated parallel to a longitudinal axis of the first sleeve portion 16. The first elongate opening 28 runs from the juncture of the first sleeve portion 16 and torso portion 14 to a point relatively adjacent to the open end of the first sleeve 16. A second 30 of the elongate openings is in the front side 20 of the torso portion 14. The second elongate opening 30 is positioned generally adjacent to a juncture of a second sleeve portion 18 and the torso portion 14. The second elongate opening 30 extends from a point adjacent to the neck opening 24 to the arm pit region where the second arm portion 18 is connected to the torso portion 14. A third elongate opening 32 is in the back side 22 of the body covering 12. The third elongate opening 32 generally extends from the neck opening 24 to a central area of the torso portion 14. The third elongate opening 32 is orientated generally perpendicular to the longitudinal axis of the first sleeve portion 16. The first 28 and second 30 elongate openings can be varied such that they are on opposite sides of the front side 20 of the body covering 12.

A plurality of closure means 34 selectively open and close the elongate openings. Each of the closure means 34 is fixedly coupled to one of the elongate openings. The closure means 34 can be any conventional closure means including buttons, snaps or hook and loop securing means. Preferably, each of the closure means is a zipper.

A pocket 36 is located on an inside surface of the front side 20 of the torso portion 14. The pocket 36 has a top side 38 and a bottom side 40. The bottom side 40 is positioned generally adjacent to a bottom peripheral edge 26 of the torso portion 14. A slot 42 is in the torso portion is located generally adjacent to the top side 38 of the pocket 36 such that a user may have access to the pocket 36 through the slot 42. The slot 42 has a closure means 44 thereon. Ideally, the closure means is a zipper.

In use, the third elongate opening 32 is opened so that a user may easily place the body covering 12 over their torso. The openings in the rest of the garment are strategically located to offer exposure to certain areas of the body so that a health care worker may easily access these areas. The body covering may be made so that the openings are located in places needed by the patient. The patient may then receive treatments such as dialysis and blood testing without removing the body covering.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An enhanced accessibility patient garment, said garment comprising:

a body covering, said body covering comprising a torso portion and two sleeve portions fixedly coupled thereto, said body covering having a front side and a back side, said torso portion having a neck opening therein;

a plurality of elongate openings being in said body covering;

a plurality of closure means for selectively opening and closing said elongate openings, each of said closure means being fixedly coupled to one of said elongate openings; and at least one of said elongate openings being in said front side of said torso portion and positioned along a length between said torso portion and one of said sleeve portions, the opening being located along a slanted line extending from a lower portion of a junction between one of said sleeves and the neck opening of the torso portion.

2. The enhanced accessibility patient garment as in claim 1, said plurality of openings further comprising:

at least one of said elongate openings being in said front side of one of said sleeve portions and being generally orientated parallel to a longitudinal axis of the respective sleeve portion, said opening terminating at a location spaced from an end of the sleeve such that a cuff portion of the sleeve does not open at said end of the sleeve.

3. The enhanced accessibility patient garment as in claim 1, wherein at least one of said elongate openings being in said back side of said body covering, said elongate opening in said back side generally extending from said neck opening to a central area of said torso portion.

4. The enhanced accessibility patient garment as in claim 1, wherein each of said closure means comprises a zipper.

5. An enhanced accessibility patient garment, said garment comprising:

a body covering, said body covering comprising a torso portion and two sleeve portions fixedly coupled thereto, said body covering having a front side and a back side, said torso portion having a neck opening therein, said body covering comprising a cloth material;

a plurality of elongate openings being in said body covering, a first elongate opening being in said front side of a first of said sleeve portions, said first elongate opening being generally orientated parallel to a longitudinal axis of said first sleeve portion, a second of said elongate openings being in said front side of said torso portion, said second elongate opening being positioned generally along a juncture of a second sleeve portion and said torso portion, a third elongate opening being in said back side of said body covering, said third elongate opening generally extending from said neck opening to a central area of said torso portion, said third elongate opening being orientated generally perpendicular to said longitudinal axis of said first sleeve portion;

a plurality of closure means for selectively opening and closing said elongate openings, each of said closure means being fixedly coupled to one of said elongate openings, each of said closure means comprises a zipper; and a pocket, said pocket being located on an inside surface of said front side of said torso portion, said pocket having a top side and a bottom side, said bottom side being positioned generally adjacent to a bottom peripheral edge of said torso portion, a slot being in said torso portion, said slot being located generally adjacent to said top side of said pocket such that a user may have access to said pocket through said slot, said slot having a closure means thereon, said closure means being a zipper.

6. An enhanced accessibility patient garment, said garment comprising:

a body covering, said body covering comprising a torso portion and two sleeve portions fixedly coupled thereto, said body covering having a front side and a back side, said torso portion having a neck opening therein, said body covering comprising a cloth material;

a plurality of elongate openings being in said body covering, a first elongate opening being in said front side of a first of said sleeve portions, said first elongate opening being generally orientated parallel to a longitudinal axis of said first sleeve portion, a second of said elongate openings being in said front side of said torso portion, said second elongate opening being positioned generally adjacent to a juncture of a second sleeve portion and said torso portion, a third elongate opening being in said back side of said body covering, said third elongate opening generally extending from said neck opening to a central area of said torso portion, said third elongate opening being orientated generally perpendicular to said longitudinal axis of said first sleeve portion;

a plurality of closure means for selectively opening and closing said elongate openings, each of said closure means being fixedly coupled to one of said elongate openings, each of said closure means comprises a zipper.

7. The enhanced accessibility garment of claim 6, additionally comprising a pocket, said pocket being located on an inside surface of said front side of said torso portion, said pocket having a top side and a bottom side, said bottom side being positioned generally adjacent to a bottom peripheral edge of said torso portion, a slot being in said torso portion, said slot being located generally adjacent to said top side of said pocket such that a user may have access to said pocket through said slot, said slot having a closure means thereon, said closure means being a zipper.

* * * * *